United States Patent [19]

Husson et al.

[11] 4,162,719

[45] Jul. 31, 1979

[54] ELEVATOR SYSTEM

[75] Inventors: Alan L. Husson, Hackettstown; Marvin Kurland, East Brunswick, both of N.J.

[73] Assignee: Westinghouse Electric Corp., Pittsburgh, Pa.

[21] Appl. No.: 856,065

[22] Filed: Nov. 30, 1977

[51] Int. Cl.[2] ..... B66B 5/02

[52] U.S. Cl. ..... 187/29 R

[58] Field of Search ..... 187/29

[56] References Cited

U.S. PATENT DOCUMENTS

| | | | |
|---|---|---|---|
| 2,695,077 | 11/1954 | Suozzo | 187/29 |
| 3,584,707 | 6/1971 | Suozzo et al. | 187/29 |
| 3,645,361 | 2/1972 | Stichweh et al. | 187/29 |
| 3,854,554 | 12/1974 | Booker, Jr. | 187/29 |
| 3,973,648 | 8/1976 | Hummert et al. | 187/29 |
| 4,082,164 | 4/1978 | Sackin et al. | 187/29 |

*Primary Examiner*—J. V. Truhe
*Assistant Examiner*—W. E. Duncanson, Jr.
*Attorney, Agent, or Firm*—D. R. Lackey

[57] ABSTRACT

An elevator system including a plurality of elevator cars capable of individual, independent control, and a system processor which places the plurality of elevator cars under group control. A monitor responsive to the calls for elevator service, and the resetting thereof when a call has been served, removes the elevator cars from group control to allow them to operate upon independent control, when a call for elevator service exists for a predetermined period of time during which no call resets were generated.

7 Claims, 2 Drawing Figures

ELEVATOR SYSTEM

BACKGROUND OF THE INVENTION 1. of the Invention

The invention relates in general to elevator systems, and more specifically to elevator systems which include a plurality of elevator cars under the control of a system processor.

2. Description of the Prior Art

When a building requires more than one elevator car to serve the traffic, some sort of supervisory control means is usually provided in order to insure efficient elevator service. For example, in U.S. Pat. No. 2,695,077, which is assigned to the same assignee as the present application, the elevator cars are dispatched successively from a dispatching floor by a main dispatching device. Failure of the main dispatching device would terminate all elevator service once all of the elevator cars have returned to the main dispatching floor. Thus, this patent discloses the use of an emergency dispatching device, in order to continue elevator service.

U.S. Pat. No. 3,854,554, which is assigned to the same assignee as the present application, discloses an improved supervisory system control arrangement for a plurality of elevator cars, in which the cars are controlled by inhibit or overriding signals, rather than by direct commands. The elevator cars each include a car controller which enables the associated elevator car to independently respond to a registered hall call. The supervisory system control decides which elevator car should answer a specific hall call and issues signals which inhibit the other elevator cars from responding to the call. Failure of the supervisory control in a mode in which inhibit signals are not sent to the cars does not terminate elevator service, and it does not require a standby emergency dispatcher, as all elevator cars are automatically on independent control in the absence of inhibit signals.

Failure of the supervisory control in a mode which may continuously provide inhibit signals, or otherwise adversely affect the ability of the elevator cars to operate properly, is detected by monitoring a selected function of the supervisory control. For example, when the supervisory system control includes a digital computer with the operating strategy stored in the memory thereof in the form of a program, the stored program must be run repeatedly to continuously update the systems. U.S. Pat. No. 3,854,554 suggests a hardwired timing circuit, as opposed to a software timing circuit, whose output is held high by periodic accessing by the stored operating program. Failure of the supervisory control to access the timing circuit at the proper frequency allows it to time out and provide a low signal which is used to block any signals which may be provided by the supervisory control from being considered by the car controllers of the various elevator cars.

SUMMARY OF THE INVENTION

Briefly, the present invention is a new and improved elevator system having a plurality of elevator cars and a system processor. The elevator system includes hall call monitoring means which indirectly, but very effectively, monitors the dispatching ability of the system processor. A hardwired circuit monitors hall calls, and the resetting of hall calls. A timer, which is set to time out in a predetermined period of time such as three minutes, is allowed to run whenever there are any hall calls registered in the associated building. The timer is reset each time a hall call in the building is reset. If there is one or more registered hall calls in the building, but no hall calls have been reset in the predetermined period of time set on the timer, the monitoring circuit issues signals which reset all hall calls, reset the system processor, and reset the call monitoring timer. The monitoring circuit also "remembers" that a malfunction has occurred once. A subsequently registered hall call now starts the timer. If the timer times out again, the call monitoring circuit on this second detection of a malfunction assumes that the system processor has malfunctioned. It now provides a signal which removes all of the elevator cars from the control of the system processor, allowing them to automatically answer hall calls based on the strategy built into the individual car controllers. The call monitoring function of the present invention may be used alone, or in conjunction with other system monitoring functions. For example, it may be used with the program monitor hereinbefore described relative to U.S. Pat. No. 3,854,554.

BRIEF DESCRIPTION OF THE DRAWING

The invention may be better understood, and further advantages and uses thereof more readily apparent, when considered in view of the following detailed description of exemplary embodiments, taken with the accompanying drawings in which.

DESCRIPTION OF PREFERRED EMBODIMENTS

Figure 1:
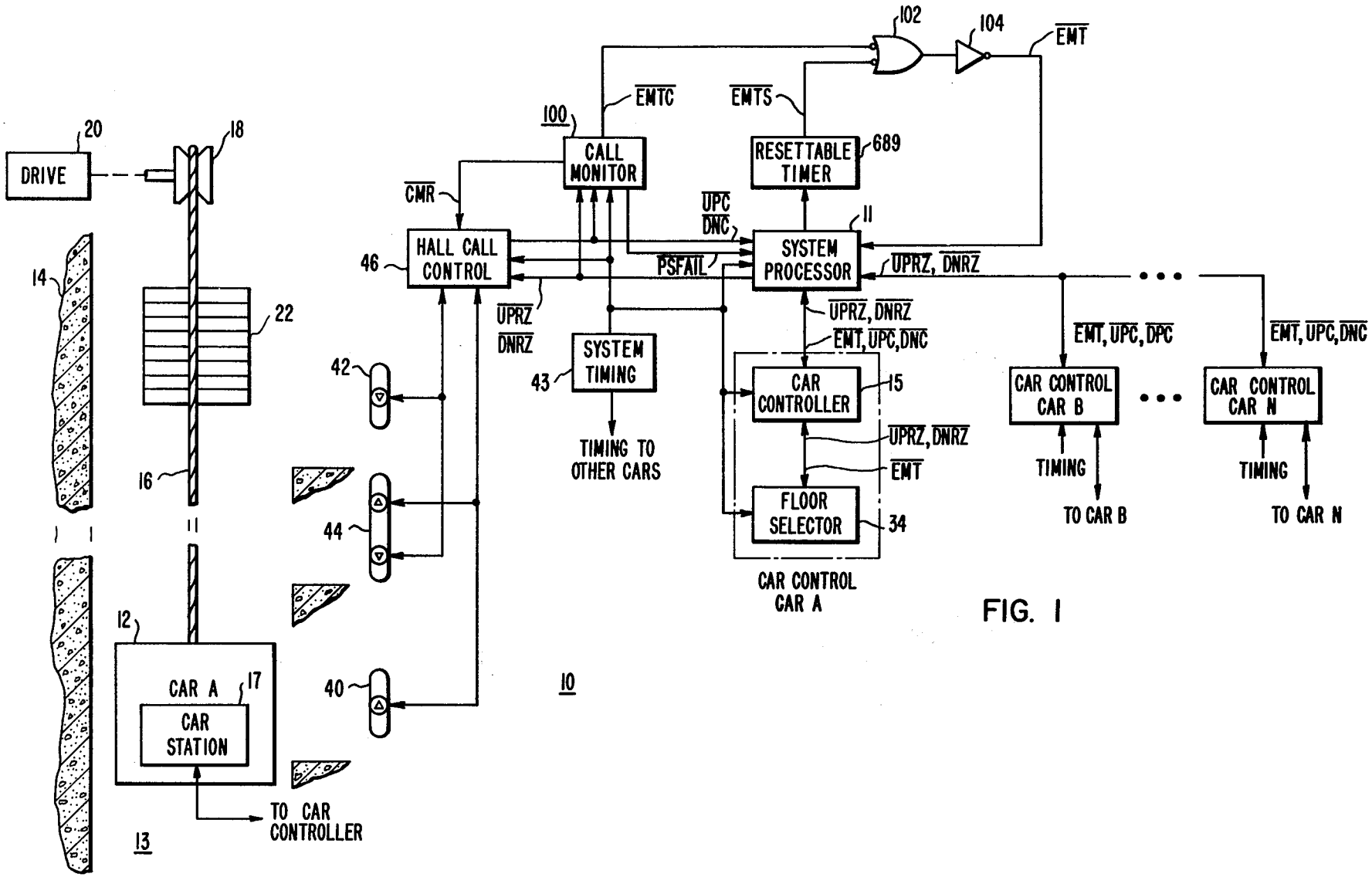
FIG. 1 is a partially schematic and partially block diagram of an elevator system constructed according to the teachings of the invention.

Referring now to the drawings, and to FIG. 1 in particular, there is shown an elevator system 10 constructed according to the teachings of the invention. Elevator system 10 includes a system processor 11 which supervises a plurality of elevator cars A through N. For purposes of example, the elevator system disclosed in the hereinbefore mentioned U.S. Pat. No. 3,854,554 will be modified according to the present invention, and the subject matter of that patent is hereby incorporated into the present application by reference.

Since each of the elevator cars of the bank of elevator cars, and their associated car controllers are similar in construction and operation, only the controls for car A will be described.

Car A includes a cab 12 and its associated car station 17. Car A is mounted in a hatchway 13 for movement relative to a structure 14 having a plurality of landings. Only the first, an intermediate, and the top landings are shown in order to simplify the drawing. Car A is supported by a plurality of wire ropes 16 which are reeved over a traction sheave 18 mounted on the shaft of a drive motor 20, such as a direct current motor as used in the Ward-Leonard drive system, or in a solid state drive system. A counterweight 22 is connected to the other end of the ropes 16.

Hall calls, as registered by push buttons mounted in the corridors or hallways, such as the up push button 40 located at the first landing, the down push button 42 located at the top landing, and the up and down push buttons 44 located at each of the intermediate landings, are recorded and serialized in hall call control 46. The resulting serialized hall call information, referred to as signals $\overline{UPC}$ and $\overline{DNC}$ for serialized up and down hall calls, respectively, is directed to the system processor 11. The system processor 11, which in U.S. Pat. No. 3,854,554 is a programmable system processor having a memory and operating strategy stored therein, directs the hall calls to the car controllers of the various elevator cars, along with control signals provided by the system processor to effect efficient service for the various floors of the building and effective use of the cars. The timing for controlling the serialization of all information and orderly flow thereof between the elevator cars and the system processor is shown generally at 43.

The car control for car A includes a car controller 15 and a floor selector 34. The floor selector 34 receives signals indicative of the position of the car A in the hatchway 13, and it also controls a speed pattern generator (not shown) which generates a speed reference signal for a motor controller (not shown) which in turn provides the voltage for the drive motor 20.

The floor selector 34 keeps track of the car A and the calls for service for the car, it provides the request to accelerate signals to the speed pattern generator, and it provides the deceleration signal for the speed pattern generator at the precise time required for the car to decelerate according to a predetermined deceleration pattern and stop at a predetermined floor for which a call for service has been registered. The floor selector 34 also provides signals for controlling such auxiliary devices as the door operator and hall lanterns, and it controls the resetting of the car call and hall call controls when a car or hall call has been serviced. The up and down hall call resets which are sent to the hall control 46 via the system processor 11, are serialized and referred to as signals $\overline{UPRZ}$ and $\overline{DNRZ}$, respectively.

The floor selector 34, in the absence of overriding control and inhibit signals from the system processor 11, includes control which enables its associated car to serve car calls placed in the car station 17 located within the car, and to serve hall calls for elevator service placed at the call stations located in the hallways of the various floors. The usual strategy followed by the car control enables a car to answer all hall calls ahead of the car which request service in its travel direction. When there are no hall calls ahead of the car requesting service in the travel direction of the car, or the car arrives at a terminal floor while serving a car call, the car reverses its travel direction. The car will then answer hall calls ahead of the car which request travel in this reversed travel direction.

U.S. Pat. No. 3,750,850, which is assigned to the same assignee as the present application, discloses a floor selector which provides the hereinbefore described operating strategy, and it is hereby incorporated into the present application by reference.

As disclosed in the incorporated U.S. Pat. No. 3,854,554, the programmable system processor may include a hardwired timing circuit 689 which is periodically accessed by the software program of the system processor 11. Failure of the system processor to reset the timer 689 before it times out indicates a malfunction in the system processor and the timer provides a low or true signal $\overline{EMT}$ which is sent to the car controllers of the various elevator cars. A true signal $\overline{EMT}$ overrides any signals the system processor may be providing, to place the cars on independent operation, also referred to as "through trip" operation. It is possible for the system processor 11 to malfunction in a manner such that timer 689 is reset at the proper interval, with no dispatching, or at least ineffective dispatching, being performed by the system processor.

In the present invention, the hall calls, and the resetting thereof, are monitored in a hall call monitor 100. Call monitor 100 may be used in conjunction with timer 689, or in place of timer 689. For purposes of example, it will be described in conjunction with timer 689. The output of the call monitor 100 is associated with the output of timer 689 via a dual input NAND gate 102 and a NOT gate 104, such that a low output from either the call monitor 100 or the resettable timer 689, or both, will produce a true signal EMT at the output of NOT gate 104. When the outputs of both the call monitor 100 and timer 689 are high, the output of NAND gate 102 is low, which is inverted to a high signal $\overline{EMT}$ by NOT gate 104. A low output by either the monitor 100 or the timer 689, or both, drives the output of NAND gate 102 high, and the NOT gate 104 provides a low signal $\overline{EMT}$. In order to distinguish the different outputs of timer 689 and the call monitor 100, the output of timer 689 is referenced $\overline{EMTS}$, and the output of call monitor 100 is referenced $\overline{EMTC}$.

Call monitor 100 includes a timer which is started by any up hall call in serial signal $\overline{UPC}$, or any down hall call in serial signal $\overline{DNC}$. The timer is reset each time an up hall call reset appears in serial signal $\overline{UPRZ}$, and each time a down hall call reset appears in serial signal $\overline{DNRZ}$. The timer is set to time out and provide a low or true signal $\overline{EMTC}$ after an appropriate time selected to be longer than the longest time encountered in normal service for a reset signal to be generated when there is one or more hall calls registered. Three minutes is a suitable time, for most elevator systems. Thus, as long as there is an unanswered hall call in the building, the timer will be running, and each hall call reset signal will reset the timer to the start of the preset timing period.

If the timer in the call monitor 100 times out a first time, the call monitor enters a first correction stage by resetting all hall calls with a true master hall call reset signal $\overline{CMR}$, it resets the system processor 11 to a selected initial condition, such as the normal reset condition upon initial startup of the system, via a true signal $\overline{PSFAIL}$, and it resets its timer to the start of the timing period. Signal $\overline{EMTC}$ remains high at this point. A subsequently registered hall call will start the timer running again. If there is a true system malfunction, it will time out again. This second timing out of the timer initiates the next stage of circuit correction by providing a true signal $\overline{EMTC}$. A true signal $\overline{EMTC}$ drives the output of NAND gate 102 high and the output of NOT gate 104 low, to provide a low or true signal $\overline{EMT}$ which places all of the elevator cars on independent control. Call monitor 100 is reset each time power is removed therefrom and returned thereto, such as at the start of each day. Thus, if it detects a single malfunction in an operating day, it will be reset the next day such that a single malfunction on the next day will provide the first stage of correction, and not a true signal $\overline{EMTC}$.

Figure 2:
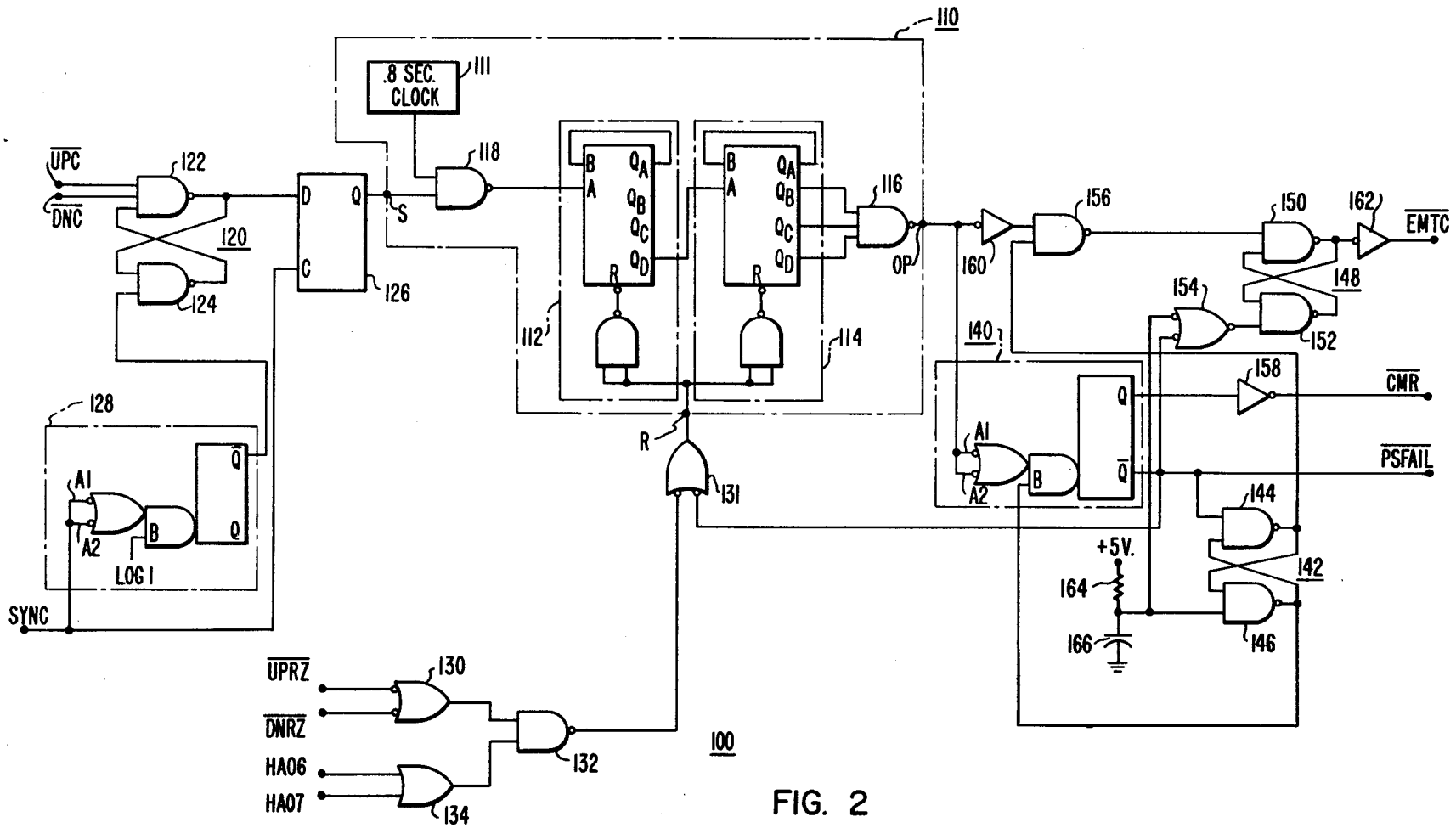
FIG. 2 is a schematic diagram of a hall call monitoring circuit which may be used for the hall call monitoring function shown generally in FIG. 1.

FIG. 2 is a schematic diagram of a hall call monitoring circuit 100 which may be used for this function shown generally in FIG. 1. Monitoring circuit 100 includes a timer 110 having an input terminal S for starting the timer, an input terminal R for resetting the timer, and an output terminal OP which switches to a predetermined logic level, such as zero, when the timer reaches the end of a predetermined timed period, and which is otherwise at the logic one level. As illustrated in FIG. 2, timer 110 may be constructed of a clock 111, a dual input NAND gate 118, a three input NAND gate 116, and two 4-bit ripple through counters 112 and 114, such as Texas instruments SN7493. input terminal S and clock 111 are connected to the two inputs of NAND gate 118. The output of NAND gate 118 is connected to the A input of counter 112. The QA output of counter 112 is connected to its input terminal B, and the QD output of counter 112 is connected to the A input of counter 114. The QA output of counter 114 is connected to its B input. The QB, QC and QD outputs of counter 114 are connected to the three inputs of NAND gate 116. The output of NAND gate 116 is connected to output terminal OP. Output QD of counter 112 provides output pulses at one-sixteenth the input rate. Outputs QB, QC and QD of counter 114 will all be at the logic one level at the same time on input count 14. Thus, if timer 110 is not reset to zero by a low or true reset signal applied to input terminal R, output terminal OP will go low after 224 pulses (16×14) are applied to input terminal S. If a three-minute timer is desired, a 0.8 second clock may be used, as illustrated. The 0.8 second clock may be provided by system timing 43.

Input terminal S of timer 110 is connected to a circuit which provides a high signal as long as there is an up or down hall call registered in the building, enabling NAND gate 118 to pass clock pulses to the counter 112. When there are no hall calls in the building, the circuit provides a logic zero to input terminal S and thus to NAND gate 118, preventing pulses from the 0.8 second timer 111 from being applied to the counter 112.

A circuit which provides a logic one as long as there is a hall call in the building, and otherwise a logic zero, includes a flip-flop 120 formed of a pair of cross-coupled NAND gates 122 and 124, a D-type flip-flop 126, such as Texas Instruments SN7474, and a monostable multivibrator or one-shot 128, such as Texas Instruments SN74121.

Serial up and down hall calls $\overline{UPC}$ and $\overline{DNC}$ are applied to two input terminals of NAND gate 122, and the $\overline{Q}$ output of the one-shot 128 is connected to an input of NAND gate 124. Input B of one-shot 128 is tied to the logic one level, and the A1 and A2 inputs of the one-shot 128 are connected to receive a timing signal SYNC from system timing. Timing signal SYNC is also connected to the clock input of flip-flop 126.

System timing 43 repetitively generates a group of scan slots, as shown in FIG. 12A of the incorporated U.S. Pat. No. 3,854,554, with each floor of the building being associated with a predetermined scan slot. An up or down hall call registered at a specific floor will appear in the scan slot associated with that floor. Signal SYNC may be generated in the first scan slot of each group of scan slots, such as signal SYNCS shown in FIG. 13A of the incorporated patent, or some other suitable signal which is true only during the initial scan slot of a basic set of scan slots.

When there are no hall calls in the building, NAND gate 122 has a logic zero output. Signal SYNC clocks the logic level appearing at the D input of flip-flop 126 to the Q output, on the positive going transition of the signal SYNC. The negative going transition of signal SYNC triggers one-shot 128, which, after predetermined selected time delay, such s 0.5 millisecond, provides a momentary logic zero signal at its $\overline{Q}$ output, which resets flip-flop 120. When there are no hall calls in the building, the output of NAND gate 122 will be low each time flip-flop 126 is clocked, and the low Q output of flip-flop 126 will maintain NAND gate in a blocked condition, preventing the 0.8 second clock signals from being applied to timer 110.

Any registered hall call, up or down, will appear as a logic zero signal in the appropriate scan slot of signal $\overline{UPC}$ or $\overline{DNC}$, respectively, causing flip-flop 120 to set and provide a logic one at the output of NAND gate 122. Then, when signal SYNC is provided, it will clock the logic one to the Q output of flip-flop 126 and enable NAND gate 118 to pass clock pulses, starting timer 110. Flip-flop 126 thus latches the indication of a hall call on flip-flop 120, and flip-flop 120 is later reset by the same signal SYNC at the start of next scan. As long as there is a hall call in the building, the output of NAND gate 122 will always be at the logic one level when the D input of flip-flop 126 is clocked to its Q output, maintaining the Q output high and continuously enabling NAND gate 126.

If no hall call is reset within the preselected timing period of timing circuit 110, the output terminal OP will go low at the end of the timing period. Any reset of a hall call will reset timer 110 to the start of the timing period. The reset circuitry includes dual input NAND gates 130, 131 and 132, and an OR gate 134.

Each basic scan slot is divided into sixteen high-speed scan slots HA00 through HA15, as shown in FIG. 13B of the incorporated U.S. Pat. No. 3,854,554. The down and up hall call resets $\overline{DNRZ}$ and $\overline{UPRZ}$, respectively, appear in the high-speed scan slots 6 and 7, respectively, as shown in FIG. 20 of the incorporated Patent. Thus, NAND gate 132 may be enabled to "look" for hall call resets at one of its inputs by providing a logic one at the other of its inputs during high-speed scan slots HA06 and HA07. Timing signals HA06 and HA07 are applied to the two inputs of OR gate 134, and the output of OR gate 134 is applied to an input of NAND gate 132. The output of NAND gate 132 is connected to an input of NAND gate 131. The output of NAND gate 131 is connected to the reset terminal R of timer 110. The other input of NAND gate 131 is connected to receive a signal $\overline{PSFAIL}$, which will reset timer 110 when it goes low, as will be hereinafter explained. When timing signals HA06 and HA07 are both at the logic zero level, NAND gate 132 applies a logic one to NAND gate 131, and as long as the other input to NAND gate 131 is also a logic one, the reset input R will be at the logic zero level, preventing the reset of timer 110. During scan slot HA06 and continuing through scan slot HA07, the output of OR gate 134 will be at the logic one level. The serial up and down hall call reset signals $\overline{UPRZ}$ and $\overline{DNRZ}$ are applied to the two inputs of NAND gate 130, and the output of NAND gate 130 is applied to an input of NAND gate 132. A true hall call reset signal forces the output of NAND gate 130 high. An indication of a hall call reset at the proper time, i.e., during high-speed scan slots HA06 and HA07, will force the output of NAND gate 132 low and the output of NAND gate 131 high to reset timer 110. As long as hall calls are in the system and hall call resets are being generated by the elevator cars, the output terminal OP of timer 110 will be high. If one or more hall calls are in the system and a hall call reset is not provided within the preselected time or timer 110, output terminal OP will go to the logic zero level.

The circuitry for responding to the logic zero level of output terminal OP includes a one-shot 140, such as Texas Instruments SN74121, a flip-flop 142 formed of cross-coupled NAND gates 144 and 146, a flip-flop 148 formed of cross-coupled NAND gates 150 and 152, an AND gate 154, a NAND gate 156, NOT gates 158, 160 and 162, a resistor 164, and a capacitor 166.

The output terminal OP of timer 110 is connected to the input of one-shot 140. Should the timer 110 time out and its output terminal OP go low, the Q output of one-shot 140 will momentarily go high, which is inverted by NOT gate 158 to provide a true signal $\overline{CMR}$ which resets all registered hall calls. The $\overline{Q}$ output will momentarily go low, providing a true signal $\overline{PSFAIL}$ which resets the programmable system processor 11. The $\overline{Q}$ output is also connected to an input of NAND gate 131, to reset timer 110 when $\overline{Q}$ goes low. The $\overline{Q}$ output of one-shot 140 also sets flip-flop 142 to provide a logic one at the output of NAND gate 144, which is connected to one input of dual input NAND gate 156. The output of NAND gate 146 is connected to the B input of the one-shot 140. The setting of flip-flop 142 causes NAND gate 146 to apply a logic zero to the one-shot 140, preventing the one-shot 140 from triggering the next time output terminal OP goes low.

When a hall call is again registered, timer 110 will again start running. If there is a true malfunction in the dispatching portion of the system processor 11 which results in no cars answering hall calls, or such poor service that hall calls are not cancelled within the preselected time period of timer 110, timer 110 will again time out and provide a logic zero at its output terminal OP. This time, the low signal has no affect on the one-shot 140, which is blocked by flip-flop 142. The output OP is connected to the remaining input of NAND gate 156 via NOT gate 160. As hereinbefore stated, the other input is connected to the output of NAND gate 144 of flip-flop 142. The first time output terminal OP went low, NAND gate 156 was blocked by the low output of NAND gate 144. This time, however, NAND gate 156 is unblocked and its output switches low to set flip-flop 148 and provide a low signal $\overline{EMTC}$ via NOT gate 162. Signal $\overline{EMTC}$ stays low until service personnel correct the malfunction. In the meantime, the building is supplied by elevator service, because the cars are operating on their independent strategy to service the hall calls.

The turnoff of power and the return of power automatically resets flip-flops 142 and 148. A source of unidirectional potential is connected to ground via serially connected resistor 164 and capacitor 166. The junction between resistor 164 and capacitor 166 is connected to an input of NAND gate 146, and also to an input of AND gate 154. The other input of AND gate 154 is connected to the $\overline{Q}$ output of one-shot 140. When power is turned on, the input of NAND gate 146 is held low long enough to reset flip-flops 142 and 152. A true signal $\overline{PSFAIL}$ will also reset flip-flop 148 to assure that signal $\overline{EMTC}$ stays high the first time the timer 110 times out.

In summary, there has been disclosed a new and improved elevator system having a plurality of elevator cars controlled by a system processor to service a building according to a predetermined group operating strategy. The new and improved elevator system includes monitoring means which indirectly checks the system processor for malfunction by monitoring hall calls and hall call resets. A timer is allowed to run whenever there is a registered hall call in the building. The timer is reset by the resetting of any hall call in the building. If there is one or more hall calls in the building and none are reset within a preset time interval, the system is not operating properly and the monitoring means initiates a first stage of corrective action. The first stage of corrective action reinitiates the system by cancelling all hall calls and by resetting the system processor. A prospective passenger will notice the cancelling of his hall call when the illumination of the call button is extinguished, and he will reenter his hall call. The system processor will then attempt to apply a predetermined strategy in directing a selected car to serve the call. In many instances, the resetting of the hall calls and the resetting of the system processor will correct the problem. If the problem persists, the timer will time out again and the monitoring means initiates a second stage of corrective action by releasing the cars from group control. Thus, all cars will be free to answer all hall calls. The call monitoring strategy may be used in conjunction with other monitoring functions, or since the call monitoring function is a more reliable check of system processor operation, it may replace certain monitoring functions.

We claim as our invention:

1. An elevator system for a building having a plurality of floors, comprising:

a plurality of elevators cars, first means mounting said plurality of elevator cars for movement in the building to serve the floors therein, second means for registering calls for elevator service, car control means for each of said plurality of elevator cars, said car control means enabling each elevator car to respond to a call for elevator service registered on said second means, third means for operating said elevator cars under group supervisory control to serve said calls for elevator service, fourth means providing a reset signal for said second means when an elevator car serves a registered call for elevator service, and monitoring means responsive to said second and fourth means, said monitoring means including timing means having a predetermined timing period, said timing means being enabled to run as long as there is an unanswered call for elevator service registered on said second means, said timer means being reset to the start of its predetermined timing period each time said fourth means resets any registered call for elevator service, said monitoring means providing a predetermined control signal when said timing means is not reset by said fourth means and is allowed to reach the end of its predetermined timing period, said third means being responsive to said monitoring means, removing said elevator cars from group supervisory control by said third means in response to the predetermined control signal being provided by said monitoring means.

2. The elevator system of claim 1 wherein the monitoring means resets all calls for elevator service and the timing means when the timing means is allowed to run through its predetermined timing period a first time, enabling the timer to run in response to a subsequent call for elevator service registered on the second means, with said timing means providing the predetermined control signal only if allowed to run through the predetermined timing period a second time.

3. An elevator system for a building having a plurality of floors, comprising:

a plurality of elevator cars, first means mounting said plurality of elevator cars for movement in the building to serve the floors therein, second means for registering calls for elevator service, third means for operating said elevator cars to serve said calls for elevator service, fourth means providing a reset signal for said second means when an elevator car serves a registered call for elevator service, and monitoring means responsive to said second and fourth means, said monitoring means providing a predetermined control signal when a call for elevator service exists for a predetermined period of time during which no reset signal was provided by said fourth means, said monitoring means provides a reset signal which resets all calls registered on the second means, prior to providing the predetermined control signal, said third means being responsive to said monitoring means for operating said elevator cars in a selected one of first and second operating modes.

4. An elevator system for a building having a plurality of floors, comprising:

a plurality of elevator cars, first means mounting said plurality of elevator cars for movement in the building to serve the floors therein, second means for registering calls for elevator service, third means for operating said elevator cars to serve said calls for elevator service, fourth means providing a reset signal for said second means when an elevator car serves a registered call for elevator service, and monitoring means responsive to said second and fourth means, said monitoring means including timing means which is enabled to run when there is an unanswered call for elevator service registered on the second means, and which is reset to the start of a predetermined timing period each time the fourth means provides a reset signal, said monitoring means providing a reset signal for resetting all calls registered on the second means when the timing means is allowed to run through the predetermined timing period a first time, said monitoring means providing a predetermined control signal when the timing means is enabled to run by a subsequently entered call for elevator service on the second means, and it is allowed to run through the predetermined timing period a second time;

said third means being responsive to said monitoring means for operating said elevator cars in a selected one of first and second operating modes.

5. The elevator system of claim 4 wherein the third means includes supervisory control means which is reset to a predetermined state when electrical power is applied thereto, and wherein the monitoring means provides a reset signal for said supervisory control means when the timing means runs through the predetermined timing period a first time.

6. An elevator system for a building having a plurality of floors, comprising:

a plurality of elevator cars, means mounting said elevator cars for movement in the building to serve the floors therein, hall call registering means for registering calls for elevator service from at least certain of the floors, car control means for each of said elevator cars for enabling the elevator cars to individually respond to calls for elevator service, and to provide hall call reset signals when a hall call has been served, supervisory control means responsive to said hall call registering means, said supervisory control means providing signals for said car control means which control the serving of hall calls by the elevator cars according to a predetermined strategy, and call monitoring means responsive to calls for elevator service registered on said hall call registering means, and to said reset signals, said call monitoring means resetting all calls registered on said hall call registering means when a call for elevator service has been registered for a first predetermined period of time during which no hall call reset signal has been provided by any of the car control means, said call monitoring means providing a predetermined signal when a call for elevator service has been registered for a predetermined period of time, subsequent to the first predetermined period of time, during which no hall call reset signal has been provided by any of the car control means, said car control means of the elevator cars being responsive to said supervisory control means until said call monitoring means provides said predetermined signal, said car control means operating independently when said call monitoring means provides said predetermined signal.

7. An elevator system for a building having a plurality of floors, comprising:

a plurality of elevator cars, means mounting said elevator cars for movement in the building to serve the floors therein, hall call registering means for registering calls for elevator service from at least certain of the floors, car control means for each elevator car for moving the elevator car to answer calls for elevator service and for providing reset signals for the hall call means when its associated elevator car has served a registered hall call, supervisory control means responsive to said hall call registering means, said supervisory control means providing signals for said car control means of the elevator cars for controlling the serving of registered hall calls by the elevator cars according to a predetermined strategy, and call monitoring means responsive to calls for elevator service registered on said hall call means, and to said reset signals, said call monitoring means including timing means which has a predetermined timing period, said timing means running when any call for elevator service is registered on said hall call registering means, said timing means being reset to the start of its predetermined timing period each time a hall call reset signal is provided by a car control means, said call monitoring means resetting said hall call registering means and said timing means if said timing means runs through its predetermined timing period a first time, said call monitoring means providing a signal which removes said plurality of elevator cars from the supervision of said supervisory control means if said timing means is allowed to run through its predetermined timing period a second time.

* * * * *